US008955493B2

(12) United States Patent
Kuo et al.

(10) Patent No.: US 8,955,493 B2
(45) Date of Patent: Feb. 17, 2015

(54) THROTTLE VALVE BODY AND THROTTLE VALVE DEVICE HAVING THE SAME

(75) Inventors: Wei-Shin Kuo, Kaohsiung (TW); Bi-Song Huang, Kaohsiung (TW)

(73) Assignee: Kwang Yang Motor Co., Ltd., Kaohsiung (TW)

( * ) Notice: Subject to any disclaimer, the term of this patent is extended or adjusted under 35 U.S.C. 154(b) by 542 days.

(21) Appl. No.: 13/430,867

(22) Filed: Mar. 27, 2012

(65) Prior Publication Data

US 2012/0210977 A1 Aug. 23, 2012

Related U.S. Application Data

(63) Continuation-in-part of application No. 12/644,755, filed on Dec. 22, 2009, now abandoned.

(30) Foreign Application Priority Data

Dec. 26, 2008 (TW) ..... 97150962 A

(51) Int. Cl.
*F02D 9/08* (2006.01)
*F02D 9/10* (2006.01)

(52) U.S. Cl.
CPC ..... *F02D 9/1055* (2013.01)
USPC ..... 123/337; 123/339.23

(58) Field of Classification Search
CPC ..... F02D 9/1055
USPC ..... 123/337, 339.23
See application file for complete search history.

(56) References Cited

U.S. PATENT DOCUMENTS

| | | | | |
|---|---|---|---|---|
| 6,041,754 | A * | 3/2000 | Mori et al. | 123/339.23 |
| 7,156,073 | B2 * | 1/2007 | Kure | 123/337 |
| 7,353,812 | B1 * | 4/2008 | Gosdzinski et al. | 123/585 |
| 7,744,433 | B2 * | 6/2010 | Ozaki et al. | 440/1 |
| 7,980,904 | B2 * | 7/2011 | Miguchi | 440/1 |
| 2003/0205215 | A1 * | 11/2003 | Hwang et al. | 123/339.23 |
| 2010/0139617 | A1 * | 6/2010 | Akiyama et al. | 123/337 |

* cited by examiner

*Primary Examiner* — Hai Huynh
(74) *Attorney, Agent, or Firm* — Hunton & Williams LLP

(57) ABSTRACT

A throttle valve body includes a main body, a main valve, and a bypass valve. The main body includes intake and bypass passages, a sensor mounting hole, and a bypass valve mounting hole. The main valve divides the intake passage into upstream and downstream portions. The bypass valve divides the bypass passage into upstream and downstream sections that are in fluid communication respectively with the upstream and downstream portions. The sensor mounting hole extends along an axis along which the downstream section extends. The bypass valve mounting hole is in fluid communication with a portion of the bypass passage disposed between the upstream and downstream sections.

10 Claims, 7 Drawing Sheets

THROTTLE VALVE BODY AND THROTTLE VALVE DEVICE HAVING THE SAME

CROSS-REFERENCE TO RELATED APPLICATION

This is a continuation-in-part (CIP) of U.S. patent application Ser. No. 12/644,755, filed on Dec. 22, 2009, and abandoned as of the filing date of this application.

BACKGROUND OF THE INVENTION

1. Field of the Invention

The invention relates to a throttle valve device, more particularly to a throttle valve device capable of accurately detecting temperature of intake air.

2. Description of the Related Art

Referring to FIG. 1, a conventional throttle valve device is adapted for use in a vehicle (not shown). The throttle valve device comprises a throttle valve 2 and a sensor 3. Referring to FIGS. 2 and 3, the throttle valve 2 includes a throttle body 21, an intake valve 22, and a bypass valve 23. The throttle body 21 includes an intake passage 210, a bypass passage 211 in fluid communication with the intake pas sage 210, and a mounting hole 212. The intake valve 22 is mounted rotatably in the intake passage 210 and divides the intake passage 210 into an upstream port ion 2101 and a downstream portion 2102. The bypass valve 23 divides the bypass passage 211 into an upstream section 2111 and a downstream section 2112. The downstream section 2112 has a downstream end 2113 that intersects the downstream portion 2102 of the intake passage 210 at a first position (A). The mounting hole 212 intersects the downstream portion 2102 of the intake passage 210 at a second position (B). The first position (A) is spaced apart from the second position (B). The mounting hole 212 is spaced apart from the bypass passage 211. The sensor 3 is mounted in the mounting hole 212, and has a sensing portion 31 extending into the downstream portion 2102 of the intake passage 210 and spaced apart from the downstream section 2112 of the bypass passage 211.

When the vehicle is in an idle speed mode, the intake valve 22 is closed and the bypass valve 23 disposed in the bypass passage 211 is opened, such that the upstream section 2111 is in fluid communication with the downstream section 2112. Hence, intake air flows successively into the upstream portion 2101 of the intake passage 210, the upstream section 2111 and the downstream section 2112 of the bypass passage 211, and the downstream portion 2102 of the intake passage 210 (indicated by an arrow shown in FIG. 2).

An electronic control unit (ECU) (not shown) receives a temperature signal from the sensor 3 to control the amount of the intake air that enters an engine (not shown). However, since the sensing portion 31 of the sensor 3 is disposed at a position spaced apart from the downstream section 2112 of the bypass passage 211 for detecting the temperature of the intake air, the temperature detected by the sensing portion 31 is not actual intake air temperature in the downstream portion 2102 of the intake passage 21. As a consequence, the ECU cannot control the amount of the intake air effectively to conform with a desired air/fuel ratio, thus resulting in inefficient fuel consumption and air pollution.

SUMMARY OF THE INVENTION

Therefore, the object of the present invention is to provide a throttle valve body that can detect actual temperature of intake air.

According to the present invention, there is provided a throttle valve body comprising a main body, a main valve, and a bypass valve. The main body includes an intake passage, a bypass passage, a sensor mounting hole, and a bypass valve mounting hole. The main valve is disposed in the intake passage to divide the intake passage into an upstream portion and a downstream portion. The bypass valve is mounted in the bypass valve mounting hole and divides the bypass passage into an upstream section that is in fluid communication with the upstream portion of the intake passage and a downstream section that extends along a first axis. The bypass passage has a downstream end that is in fluid communication with the downstream portion of the intake passage. The sensor mounting hole extends along a second axis intersecting the first axis. The bypass valve mounting hole is in fluid communication with a portion of the bypass passage disposed between the upstream section and the downstream section.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
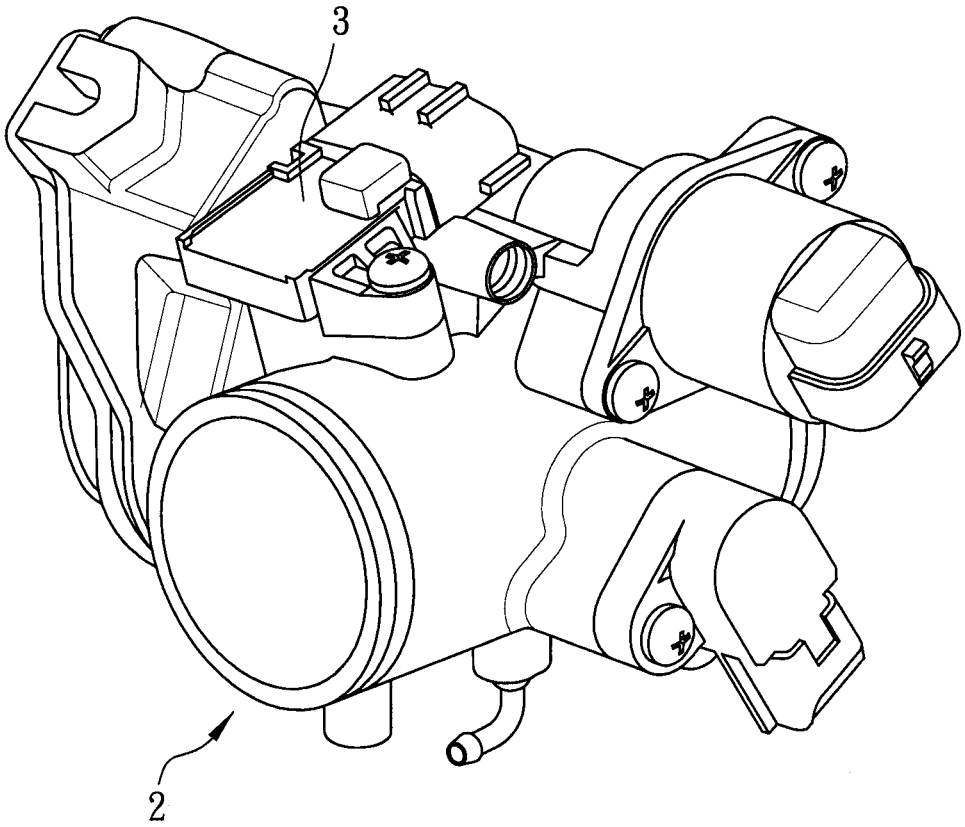
FIG. 1 PRIOR ART
FIG. 1 is a perspective view showing a conventional throttle valve device.
Figure 2:
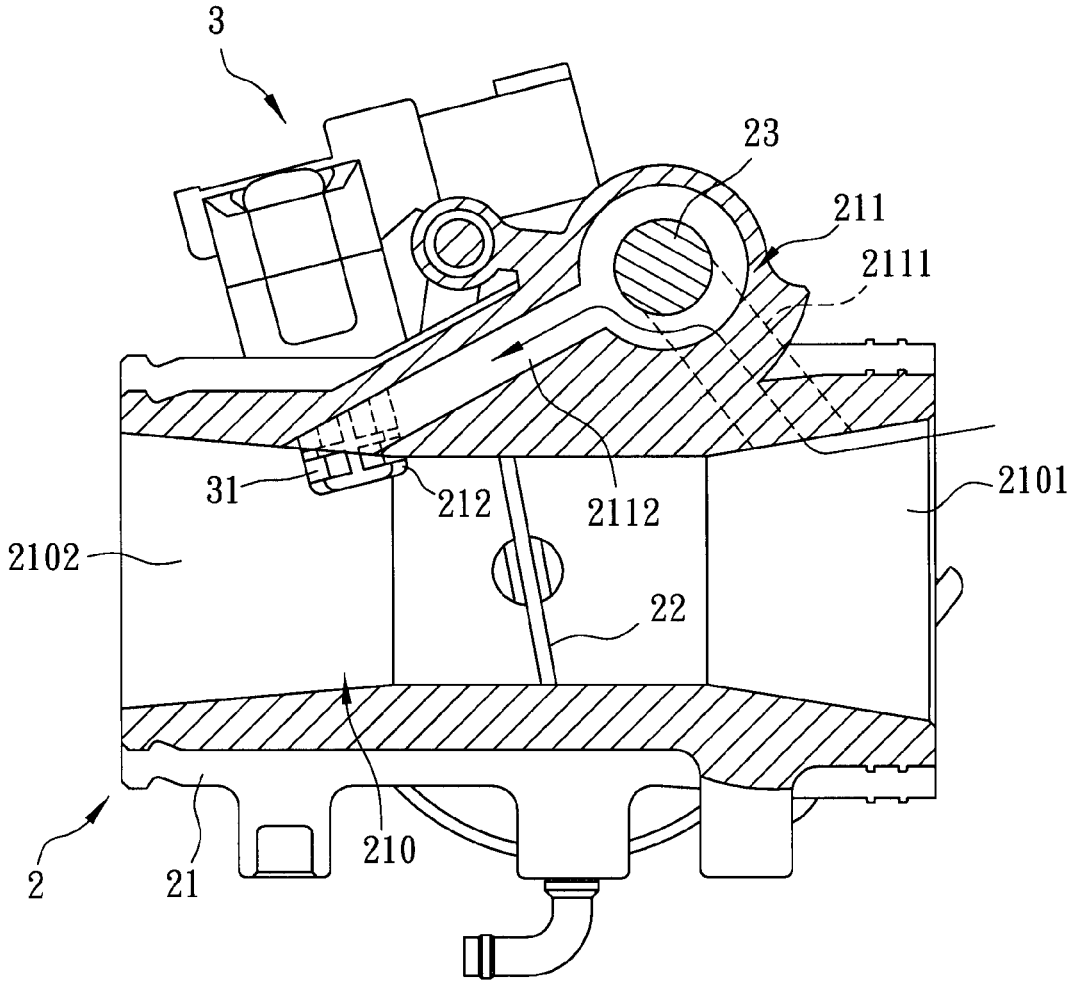
FIG. 2 PRIOR ART
FIG. 2 is a schematic sectional view of the conventional throttle valve device.

Before the present invention is described in greater detail, it should be noted that like elements are denoted by the same reference numerals throughout the disclosure.

Figure 4:
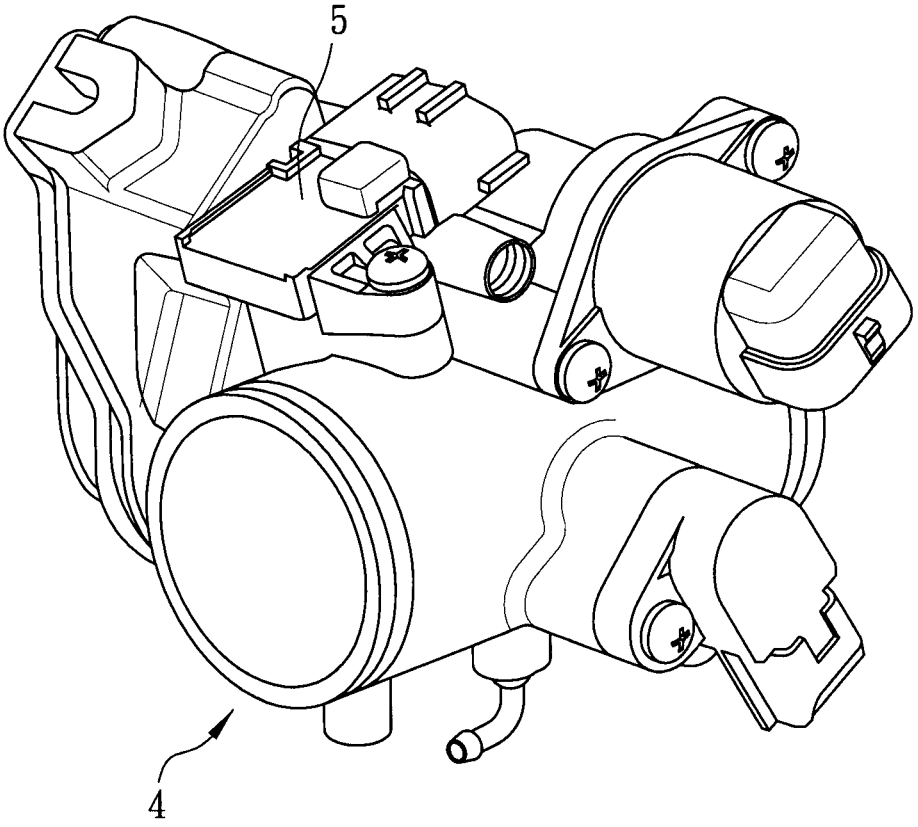
FIG. 4 is a perspective view of a first preferred embodiment of a throttle valve device according to the present invention.

Referring to FIG. 4, a throttle valve device of a first preferred embodiment of the present invention comprises a throttle valve body 4 and a sensor 5.

Figure 5:
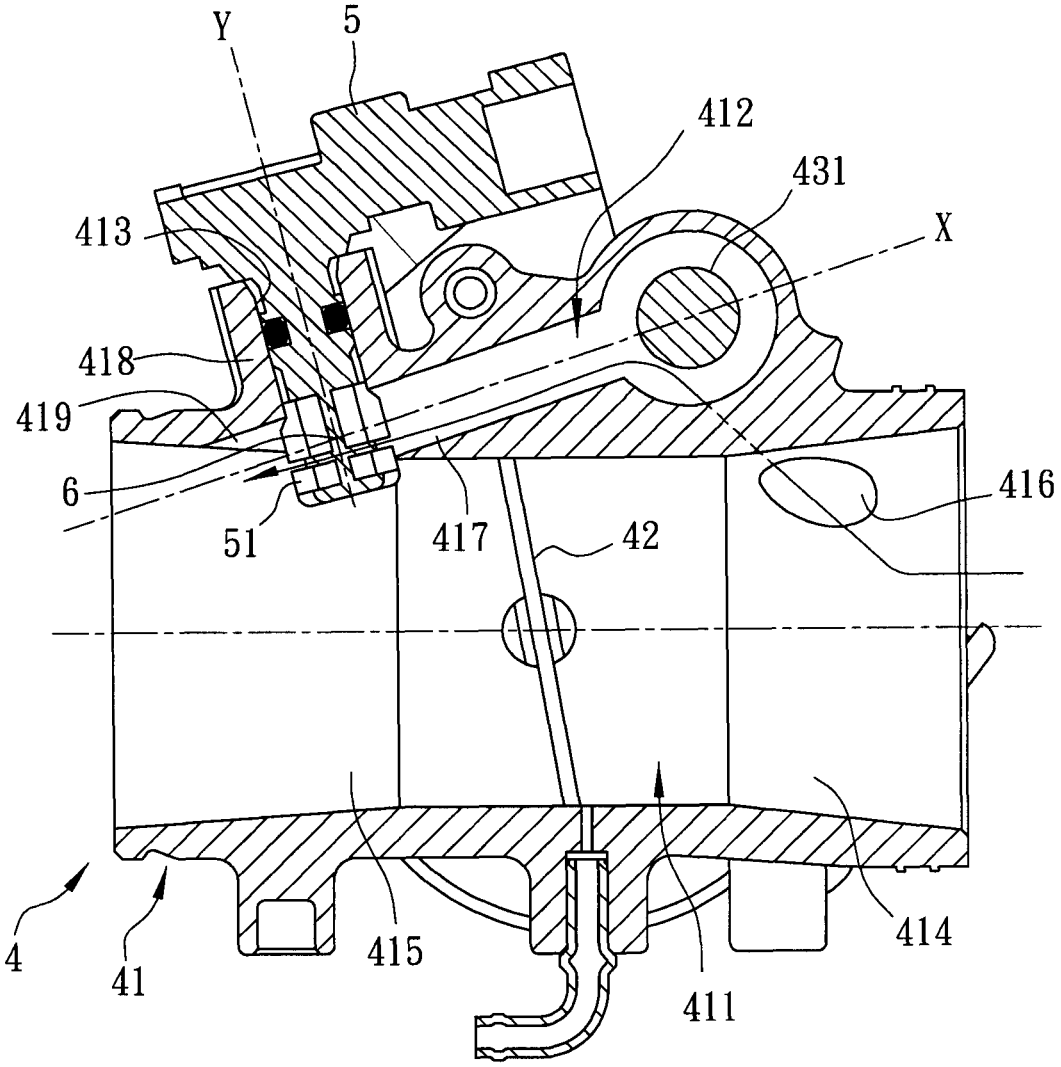
FIG. 5 is a schematic sectional view of the first preferred embodiment.

Referring to FIG. 5, the throttle valve body 4 includes a main body 41 and a main valve 42. The main body 41 has an intake passage 411, a bypass passage 412, a sensor mounting hole 413, a protrusion 418 formed on an outer surface thereof, and a bypass valve mounting hole 430. The main valve 42 is disposed in the intake passage 411 to divide the intake passage 411 into an upstream portion 414 and a downstream portion 415. The bypass passage 412 has an upstream section 416 in fluid communication with the upstream portion 414 of the intake passage 411, a downstream section 417 extending along a first axis (X), and a downstream end 419 in fluid communication with the downstream portion 415 of the intake passage 411.

The sensor mounting hole 413 extends along a second axis (Y) intersecting the first axis (X), is formed in the protrusion 418, and is in fluid communication with the intake passage 411. The first axis (X) and the second axis (Y) intersect at an intersection point 6 that is located in the downstream section 417 of the bypass passage 412 and adjacent to the downstream end 419. The sensor 5 is mounted in the sensor mounting hole 413 and has a sensing portion 51 disposed adjacent to the intersection point 6. The bypass valve mounting hole 430 is in fluid communication with a portion of the bypass passage 412 disposed between the upstream section 416 and the downstream section 417. In this preferred embodiment, the first axis (X) is substantially perpendicular to the second axis (Y).

Figure 6:
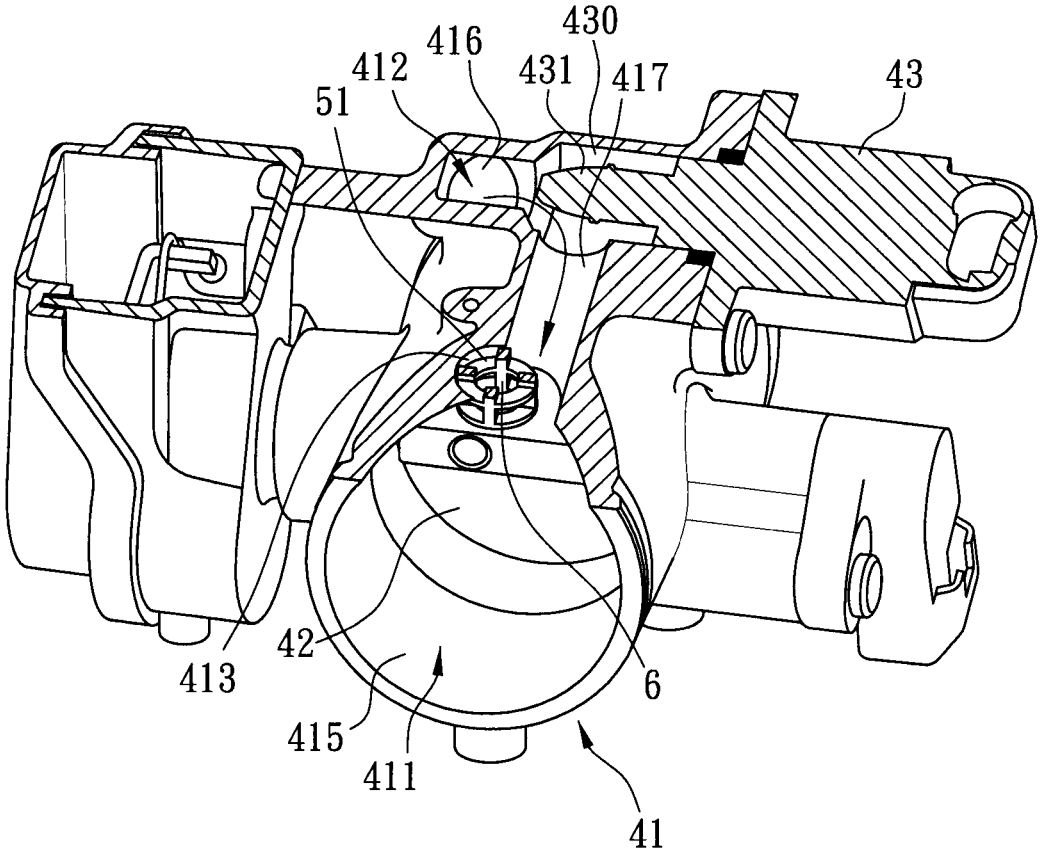
FIG. 6 is a partly sectional perspective view of the first preferred embodiment, illustrating a bypass passage and a sensor mounting hole of the throttle valve device.

Further referring to FIG. 6, the throttle valve body 4 further includes a bypass valve 43 (not shown in FIG. 5) having a bypass lever 431. When the bypass passage 412 is closed, the bypass lever 431 of the bypass valve 43 interrupts fluid communication between the upstream section 416 and the downstream section 417 of the bypass passage 412. The bypass valve 43 is mounted in the bypass valve mounting hole 430 and divides the bypass passage 412 into the upstream section 416 and the downstream section 417.

The throttle valve device of the present invention is adapted for use in a vehicle. When the vehicle is in an idle speed mode, the main valve 42 is closed and the bypass valve 43 is opened, such that the upstream section 416 is in fluid communication with the downstream section 417. Hence, intake air flows successively into the upstream portion 414 of the intake passage 411, the upstream section 416 and the downstream section 417 of the bypass passage 412, and the downstream portion 415 of the intake passage 411 (indicated by an arrow shown in FIG. 5). Therefore, the sensing portion 51 of the sensor 5 is able to detect the temperature of the intake air, and to transmit a temperature signal to an electronic control unit (ECU) (not shown). The ECU controls the amount of intake air that enters an engine (not shown) to conform with a desired air/fuel ratio.

Figure 3:
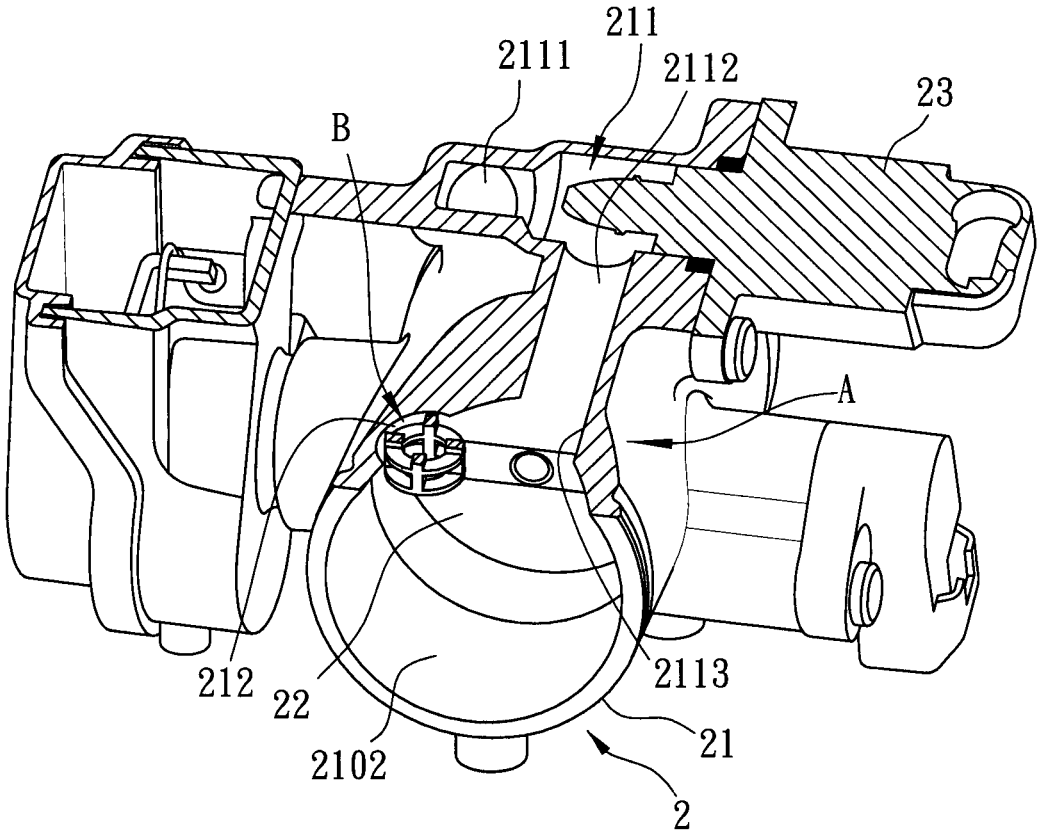
FIG. 3 PRIOR ART
FIG. 3 is a partly sectional view of the conventional throttle valve device, illustrating a bypass passage and a sensor mounting hole.

Since the sensing portion 51 is mounted in the sensor mounting hole 413 and is disposed adjacent to the intersection point 6, it can detect the temperature of the intake air in the downstream section 417 of the bypass passage 412, i.e., the sensing portion 51 can detect effectively actual intake air temperature. As a result, the accuracy of the ECU of the vehicle that controls the amount of the intake air entering the engine cylinder is increased as compared to that of the conventional throttle body 21 (see FIG. 3).

Figure 7:
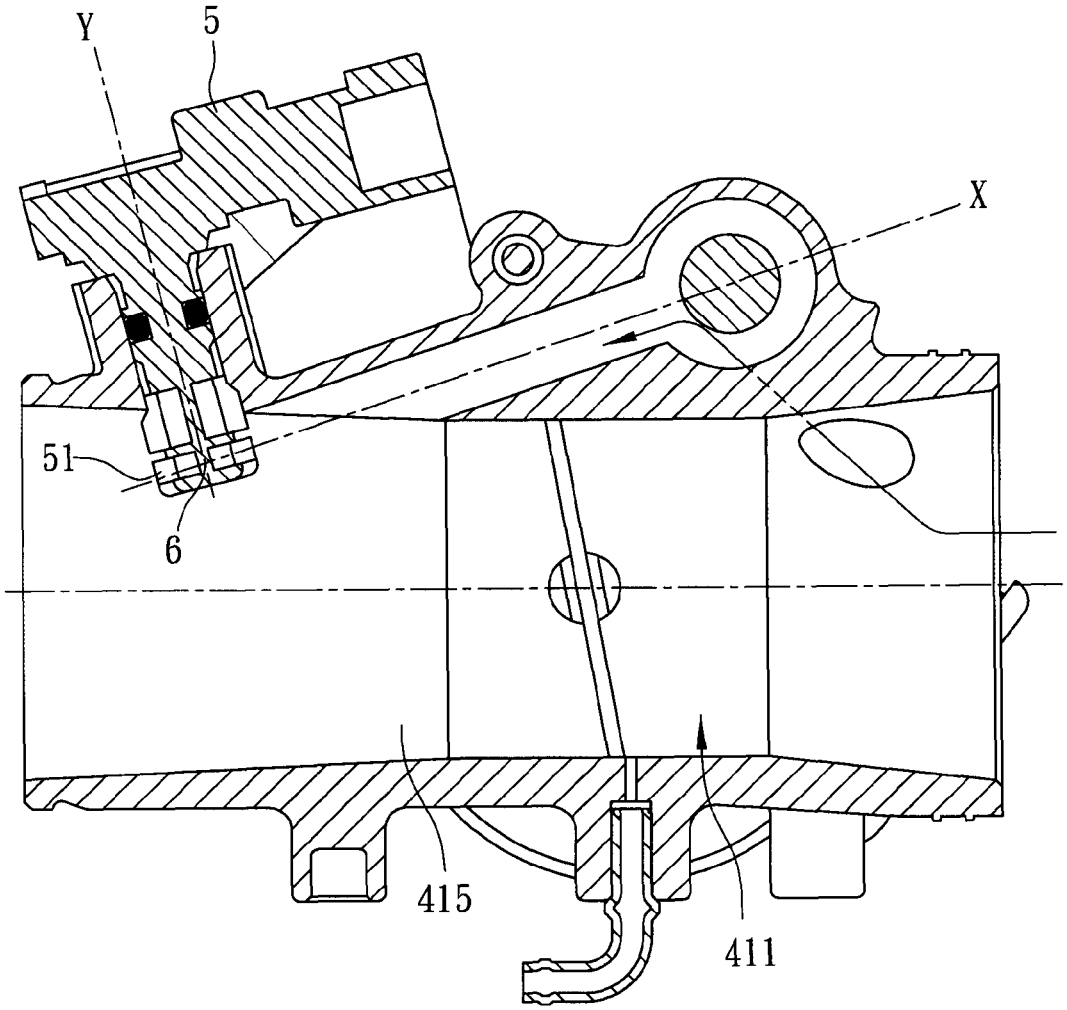
FIG. 7 is a schematic sectional view of a second preferred embodiment of a throttle valve device according to the present invention.

Referring to FIG. 7, a second preferred embodiment of the throttle valve device according to the present invention has a structure similar to that of the first embodiment. The main difference between the second embodiment and the first embodiment resides in the following. In the second preferred embodiment, the first axis (X) and the second axis (Y) intersect at an intersection point 6 that is located in the downstream portion 415 of the intake passage 411. The sensing portion 51 of the sensor 5 is disposed adjacent to the intersection point 6. The second preferred embodiment has the same advantages as those of the first preferred embodiment.

To sum up, since the sensing portion 51 of the sensor 5 is adjacent to the intersection point 6 where the first axis (X) and the second axis (Y) intersect, the sensing portion 51 can accurately detect the temperature of the intake air, and transmit the temperature signal to the ECU, to thereby control the amount of the intake air entering the engine so as to conform with the desired air/fuel ratio. As a result, inefficient fuel consumption and air pollution are minimized.

While the present invention has been described in connection with what are considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. A throttle valve body comprising:

a main body including an intake passage having an upstream portion and a downstream portion, a bypass passage having an upstream section in fluid communication with said upstream portion of said intake passage, a downstream section extending along a first axis, and a downstream end in fluid communication with said downstream portion of said intake passage, a sensor mounting hole extending along a second axis intersecting the first axis, and a bypass valve mounting hole in fluid communication with a portion of said bypass passage disposed between said upstream section and said downstream section;

a bypass valve mounted in said bypass valve mounting hole and dividing said bypass passage into said upstream section and said downstream section; and a main valve disposed in said intake passage to divide said intake passage into said upstream portion and said downstream portion.

2. The throttle valve body as claimed in claim 1, wherein the first axis and the second axis intersect at an intersection point that is located in said downstream section of said bypass passage and adjacent to said downstream end.

3. The throttle valve body as claimed in claim 1, wherein the first axis and the second axis intersect at an intersection point that is located in said downstream portion of said intake passage.

4. The throttle valve body as claimed in claim 1, wherein the first axis is substantially perpendicular to the second axis.

5. The throttle valve body as claimed in claim 4, wherein said main body further includes a protrusion formed on an outer surface thereof, said sensor mounting hole being formed in said protrusion and being in fluid communication with said intake passage.

6. A throttle valve device comprising:

a main body including an intake passage having an upstream portion and a downstream portion, a bypass passage having an upstream section in fluid communication with said upstream portion of said intake passage, a downstream section extending along a first axis, and a downstream end in fluid communication with said downstream portion of said intake passage, a sensor mounting hole extending along a second axis intersecting the first axis, and a bypass valve mounting hole in fluid communication with a portion of said bypass passage disposed between said upstream section and said downstream section;

a bypass valve mounted in said bypass valve mounting hole and dividing said bypass passage into said upstream section and said downstream section; and a main valve disposed in said intake passage to divide said intake passage into said upstream portion and said downstream portion; and a sensor mounted in said sensor mounting hole.

7. The throttle valve device as claimed in claim 6, wherein the first axis and the second axis intersect at an intersection point that is located in said downstream section of said bypass passage and adjacent to said downstream end, said sensor having a sensing portion disposed adjacent to said intersection point.

8. The throttle valve device as claimed in claim 6, wherein the first axis and the second axis intersect at an intersection point that is located in said downstream portion of said intake passage, said sensor having a sensing portion disposed adjacent to said intersection point.

9. The throttle valve device as claimed in claim 6, wherein the first axis is substantially perpendicular to the second axis.

10. The throttle valve device as claimed in claim 9, wherein said main body further includes a protrusion formed on an outer surface thereof, said sensor mounting hole being formed in said protrusion and being in fluid communication with said intake passage.

* * * * *